United States Patent [19]

Evans et al.

[11] 4,398,735

[45] Aug. 16, 1983

[54] SOLID STATE SKATE TRUCK

[75] Inventors: Brian L. Evans, Laguna Hills, Calif.; Robert R. Woodcock, Carson City, Nev.

[73] Assignee: D. Beam, Newport Beach, Calif.

[21] Appl. No.: 306,371

[22] Filed: Sep. 28, 1981

Related U.S. Application Data

[63] Continuation of Ser. No. 177,389, Aug. 12, 1980, abandoned, which is a continuation of Ser. No. 10,525, Feb. 9, 1979, abandoned.

[51] Int. Cl.[3] ..... A63C 17/02

[52] U.S. Cl. ..... 280/11.28; 280/87.04 A

[58] Field of Search ..... 280/11.19, 11.28, 11.27, 280/87.04 A, 87.04 R

[56] References Cited

U.S. PATENT DOCUMENTS

| | | | |
|---|---|---|---|
| D. 234,262 | 2/1975 | Willhoft | D34/14 C |
| 304,949 | 9/1884 | Mitchell | 280/11.28 |
| 321,227 | 6/1885 | Lancaster | 280/11.28 |
| 324,309 | 8/1885 | Doty | 280/11.28 |
| 326,540 | 9/1885 | Baker | 280/11.19 |
| 457,129 | 8/1891 | Masterson | 280/11.28 |
| 645,270 | 3/1900 | Richardson | 280/11.28 |
| 2,676,812 | 4/1954 | Owsen et al. | 280/11.26 |
| 3,355,184 | 11/1967 | Green | 280/11.19 |
| 3,377,079 | 4/1968 | Barczak | 280/11.28 |
| 3,442,523 | 5/1969 | Butler | 280/11.28 |
| 3,649,038 | 3/1972 | Huckenbeck | 280/11.19 |
| 3,774,924 | 11/1973 | Machatsch | 280/11.28 |
| 3,953,041 | 4/1976 | Buss | 280/11.26 |
| 4,152,001 | 5/1979 | Christianson | 280/11.28 |
| 4,168,842 | 9/1979 | Kimmell | 280/11.28 |
| 4,180,278 | 12/1979 | Gottlieb | 280/87.04 A |
| 4,184,693 | 1/1980 | Whitmarsh | 280/11.28 |
| 4,202,558 | 5/1980 | Olschewski et al. | 280/11.28 |

FOREIGN PATENT DOCUMENTS

| | | | |
|---|---|---|---|
| 1007224 | 4/1957 | Fed. Rep. of Germany | 280/11.28 |

*Primary Examiner*—David M. Mitchell

*Attorney, Agent, or Firm*—Schwartz, Jeffery, Schwaab, Mack, Blumenthal & Koch

[57] ABSTRACT

There is disclosed an entirely new configuration for a truck for skateboards, roller skates, and the like including a baseplate adapted to be connected to the underside of a skate, an elongate beam made from a flexible material, one end of the beam being connected to the baseplate and the beam extending at an acute angle relative thereto, and an elongate axle or axle hub rigidly connected to the other end of the beam and extending perpendicular thereto. The baseplate, the beam, and the axle or axle hub are a one-piece assembly made from a plastic material. An axle may extend through the hub for receipt of conventional wheels.

12 Claims, 7 Drawing Figures

FIG. 1.
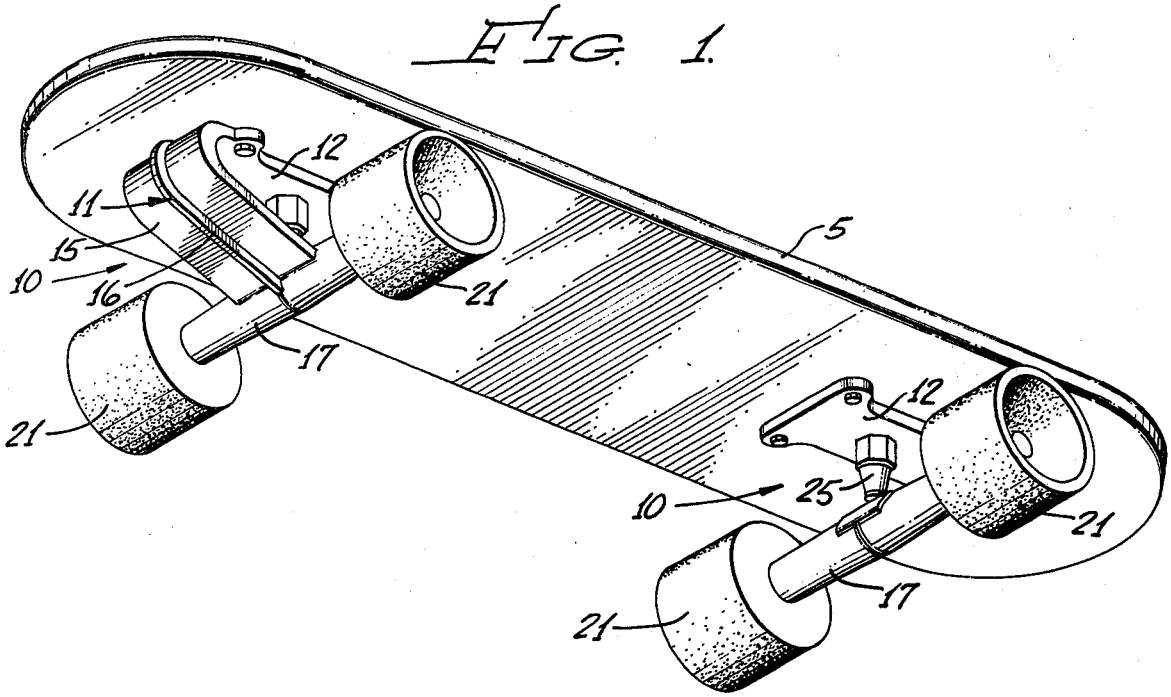
FIG. 2.
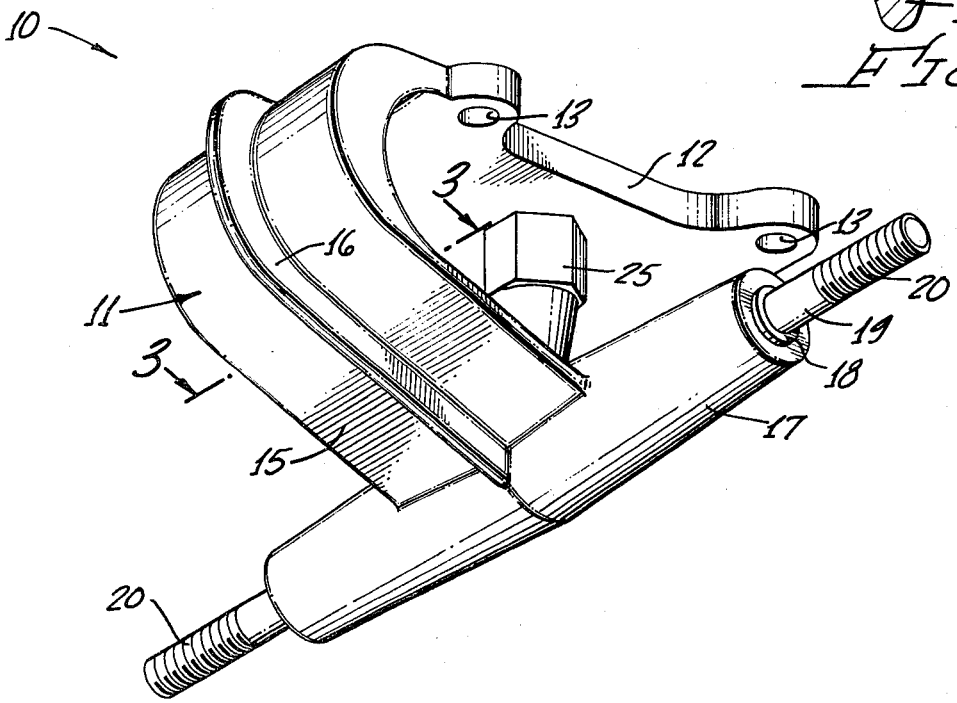
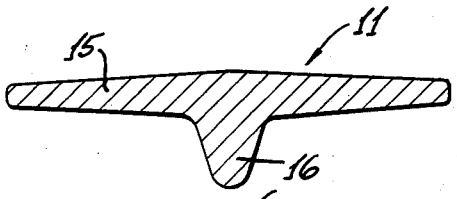
FIG. 3.

SOLID STATE SKATE TRUCK

This is a continuation of application Ser. No. 177,389, filed Aug. 12, 1980, which is a continuation of Ser. No. 10,525, filed Feb. 9, 1979, both now abandoned.

BACKGROUND OF THE INVENTION

1. Field of the Invention

The present invention relates to a solid state skate truck and, more particularly, to a virtually one-piece, injection molded, plastic, truck which solves the problems encountered heretofore in metal and rubber trucks.

2. Description of the Prior Art

At the present time, combination axle and axle steering assemblies, commonly and herein referred to as trucks for skateboards, roller skates, and the like, consist of built-up assemblies of as many as ten to twelve metal, rubber and plastic parts. Because of these many parts and the wear that they are subjected to, the parts break and wear out and must be replaced and must constantly be adjusted and readjusted. Manufacturing costs run high due to the variety of parts required and the labor required to manufacture the assemblies.

Because of the pivoting required to steer a skateboard, roller skates, or the like, the various metal parts are connected by a rubber washer, the compression of which changes due to wear and fatigue. This being the case, it is almost impossible to continuously predict how a truck including a rubber washer is going to react. As a result, skates including cnventional trucks ride in an unpredictable way.

Skates utilizing conventional trucks are subject to high speed wobble. That is, the rear truck will actually shimmy if the truck parts are too loose and, in an extreme case, the wobble will cause the rear of the skate to kick away from the rider. If the truck parts are very tight, wobble can be eliminated, but this cuts down the rider's maneuverability. Therefore, it is virtually impossible to adjust a conventional truck so as to be simultaneously stable and extremely maneuverable. Constant adjustment and readjustment is required to reach a satisfactory compromise between these two factors.

Skates with conventional trucks vibrate from road and surface irregularities. This occurs because there are solid metal parts holding other solid metal parts together. As a result, the vibration from the wheels is transferred directly to the board, which vibrations are felt by the rider.

Part of skatboarding is to slide along on the axle hub over a narrow surface, like the edge of a curb or the coping in a pool, with the wheels either straddling the surface or not touching anything at all. However, since the majority of trucks are made of metal, when the metal hits the concrete, there is a high coefficient of friction and the metal does not slide over the concrete easily. This being the case, some skateboard trucks come with a separate plastic clip which is attached to the axle hub so that the hub slides smoothly over surfaces without heavy friction problems. However, this requires the addition of a separate part.

Other problems exist with conventional trucks. They can corrode, because they include multiple metal parts they have significant weight, they do not have extreme impact resistance, and they can break without warning.

In spite of the extreme popularity of skateboarding, roller skating and the like and the awareness of the skate industry with these many problems associated with conventional trucks, no practical solution to these problems has been suggested heretofore. Obviously, the problem of constant adjustment of the truck parts could be solved by making a metal truck with no rubber washers and no adjusting screws. However, such a truck would break easily, ride very rough, and give little or no manueverability. High speed wobble in metal trucks could only be solved by solid connections to the axle hub or extreme tightening of the kingpin, both of which would reduce or totally eliminate any maneuverability. No solutions are known to the other problems discussed.

SUMMARY OF THE INVENTION

According to the present invention, a totally new concept in trucks is presented which solves all of these problems. The present truck is virtually a one-piece member and has no parts whatsoever which require adjustment or readjustment. The present truck is extremely maneuverable and is highly insensitive to high speed wobble. Because of the minimum number of parts, the present truck requires a minimum of time and labor to assemble. Furthermore, because of the absence of adjustments, a skate incorporating the present truck rides in a totally predictable way.

The present truck is highly insensitive to vibrations from road and surface irregularities. This is because the vibrations are conducted through the entire length of the truck beam member where they are absorbed. The present truck is made entirely from plastic so there is no necessity to add separate parts to permit the truck to slide smoothly over surfaces. This is because the plastic material has a low coefficient of friction.

The present truck cannot corrode, weighs significantly less than conventional trucks, has an extremely high direct impact resistance, and typically will not break without warning.

The fundamental principle of the present invention is to provide a truck incorporating a deflecting beam, one end of which is connected to the underside of a skate and the other end of which supports an elongate axle hub which has an axle extending therethrough to receive a pair of wheels. Due to the solid construction, such a truck is predictable in that it reacts exactly the same when forces are put upon it. No adjustments are required. The beam of the present truck includes a vertical section which provides resistance to vertical deflection relative to forces which give a shock action and creates a neutral or central point of turning. The beam of the present truck also includes a horizontal section which causes a slight resistance to turning but, more importantly, holds the axle hub in such a way as to prevent wobbling.

The present truck is almost entirely injection molded. All that is required for assembly is the addition of an axle and an impact peg. Both the axle and the impact peg can be molded in one piece with the remainder of the truck if desired. Because the baseplate, beam, and axle hub are made in one part, as long as the molecules do not fatigue, the entire unit is viable. While the present truck is not indestructible, when it is worn out it is cheap enough to throw away and replace.

OBJECTS, FEATURES AND ADVANTAGES

It is therefore an object of the present invention to solve the problems associated with combination axle and axle steering assemblies consisting of built-up assemblies of as many as ten to twelve metal, plastic and rubber parts. It is a feature of the present invention to solve these problems by providing an injection molded plastic truck which may be a one-piece member including a deflecting beam. The advantages to be derived are that no adjustments are required, a minimum of time and labor is required for assembly, and the truck is lighter and more inexpensive than conventional trucks.

It is a further object of the present invention to provide a truck which is both stable and extremely maneuverable. It is a feature of the present invention to provide a truck based upon an entirely different principle, i.e., the use of a deflecting beam. The advantages to be derived are that no adjustments are necessary to provide a truck which rides in a totally predictable way, with a minimum of high speed wobble.

It is a still further object of the present invention to solve the problems associated with the unpredictable nature of conventional skate trucks. It is a feature of the present invention to solve these problems by providing a truck having a solid construction. The advantage to be derived is that the present truck reacts exactly the same when reacting to forces put upon it without the necessity for constant adjustment. Another advantage is that as long as the molecules in the present truck do not fatigue, then the entire unit is viable. Another advantage is that the truck acts as a spring and vibrations are absorbed by the beam. Another advantage is that the axle hub is made of a material which slides easily over most surfaces and does not hang up from friction on concrete or cement surfaces at low or high speeds.

Still other objects, features, and attendant advantages of the present invention will become apparent to those skilled in the art from a reading of the following detailed description of the preferred embodiment constructed in accordance therewith, taken in conjunction with the accompanying drawings wherein like numerals designate like parts in the several figures and wherein:

BRIEF DESCRIPTION OF THE DRAWINGS

FIG. 1 is a perspective view of a skateboard incorporating a pair of trucks constructed in accordance with the teachings of the present invention;

FIG. 2 is a perspective view of the present truck;

FIG. 3 is a sectional view of the beam of the truck of FIG. 2;

DESCRIPTION OF THE PREFERRED EMBODIMENT

Figure 4:
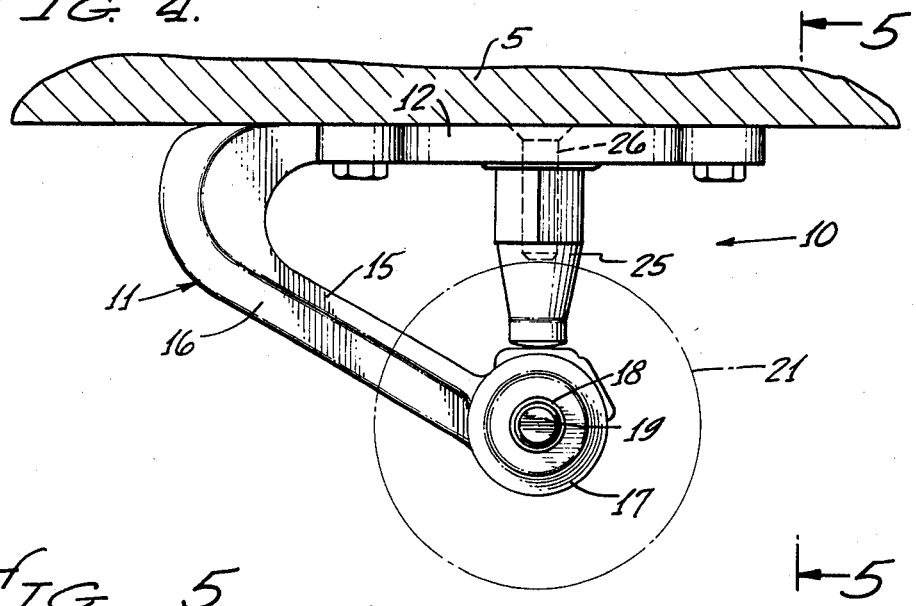
FIG. 4 is a partial side elevation view of the skateboard of FIG. 1, showing the front truck.
Figure 5:
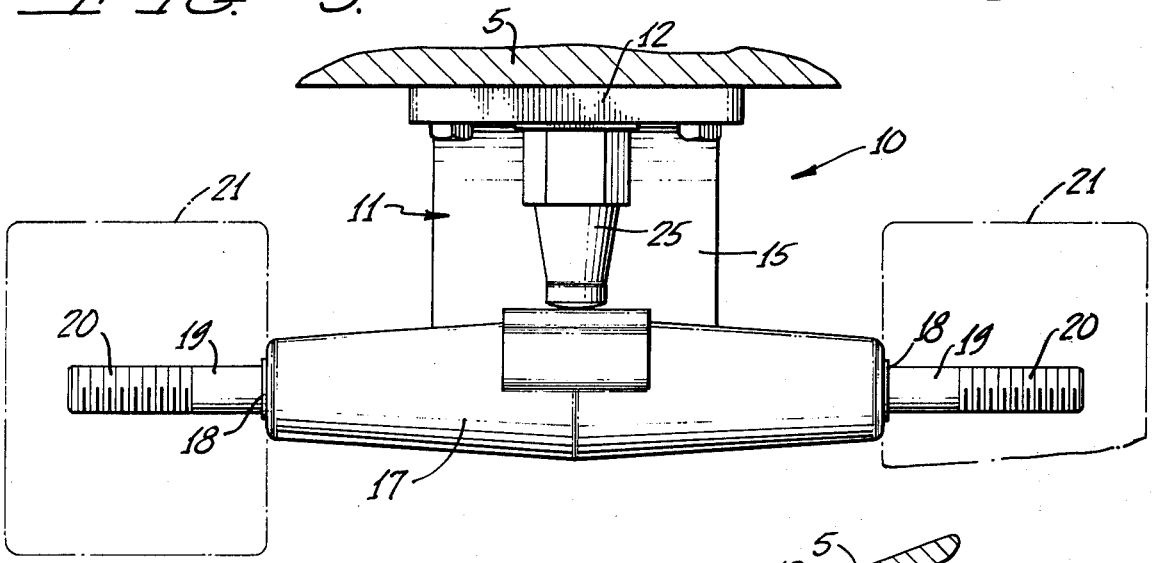
FIG. 5 is a sectional view taken along the line 5—5 in FIG. 4.

Referring now to the drawings, there is shown a conventional skateboard, generally designated 5, having connected to the underside thereof a pair of identical trucks, generally designated 10. As will be explained more fully hereinafter, the specific configuration of each truck 10 is such that it is compatible with the conventional four-hole pattern presently used in connecting trucks to skateboards generally. However, it is not necessary that truck 10 have such a configuration. Furthermore, while truck 10 will be described in its preferred embodiment as being connectable to a skateboard, it will be obvious that the principles of the present invention are equally applicable to combination axle and axle steering assemblies for other land vehicles, such as roller skates and the like, which land vehicles will, for the purposes of the present invention, be referred to as "skates".

The central principle of truck 10 is the inclusion of an elongate beam 11 made from a flexible material, one end of beam 11 being adapted to be rigidly anchored to the underside of skateboard 5, with beam 11 extending at an acute angle relative thereto. The beam 11 of the front truck 10 extends rearwardly whereas beam 11 of the rear truck 10 extends forwardly. Generally speaking, beam 11 is made from a plastic material. However, due to the variety of forces and stresses and the constant twisting and turning involved in a skate truck, it is obvious that not any plastic material is suitable. Specifically, truck 10 should be made from a nylon material and the preferred nylon material is sold by Dupont Corporation under the trademark Zytel ST 801.

One end of beam 11 may be ridiidly anchored to skateboard 5 in a variety of different ways. Presently, conventional skateboard trucks include a baseplate having a predetermined four-hole pattern for connection to skateboard 5. In order to make truck 10 interchangeable with conventional skateboard trucks, truck 10 preferably includes a baseplate 12 which is a thin, planar member having four holes 13 therein corresponding to the existing four-hole pattern. When truck 10 includes such a baseplate 12, one end of beam 11 is made as a one-piece member with one end of plate 12. However, it should be emphasized that there is no requirement that beam 11 be connected to baseplate 12 in this manner or that truck 11 include a baseplate 12 at all. Since the preferred method of manufacturing beam 11 is to injection mold it, beam 11 could be injection molded as an integral one-piece member with skateboard 5. Alternatively, any other configuration of baseplate may be used.

The angle of beam 11 relative to baseplate 12 is preferably in the range of from 30°–45°, the preferred angle being approximately 40°. Smaller angles do not permit sufficient maneuverability of truck 10. High beam angles, ones in excess of 45°, could be tolerated in the front truck but not in the rear truck. In the rear truck, serious chatter or instability would be the result.

The preferred cross-section of beam 11 is shown in FIG. 3. It is seen that beam 11 includes a first section 15 and a second section 16 positioned at a right angle to section 15. Both sections 15 and 16 are generally rectangular sections having a major and a minor axis. The width of section 15, in the direction of the major axis, is substantially greater than the thickness thereof, along the direction of the minor axis. As will be explained more fully hereinafter, this section supports the axle hub in a manner which minimizes high speed wobble. The major axis of section 15 is positioned generally horizontal.

Figure 6:
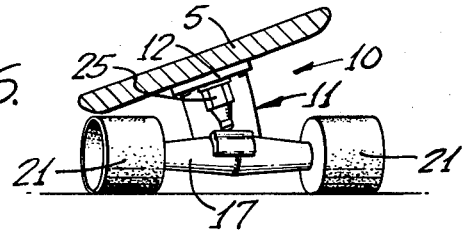
FIG. 6 is a sectional view taken transverse to the longitudinal axis of the skateboard of FIG. 1, midway between the front and rear trucks, looking forwardly, and showing the turning action of the present truck.
Figure 7:
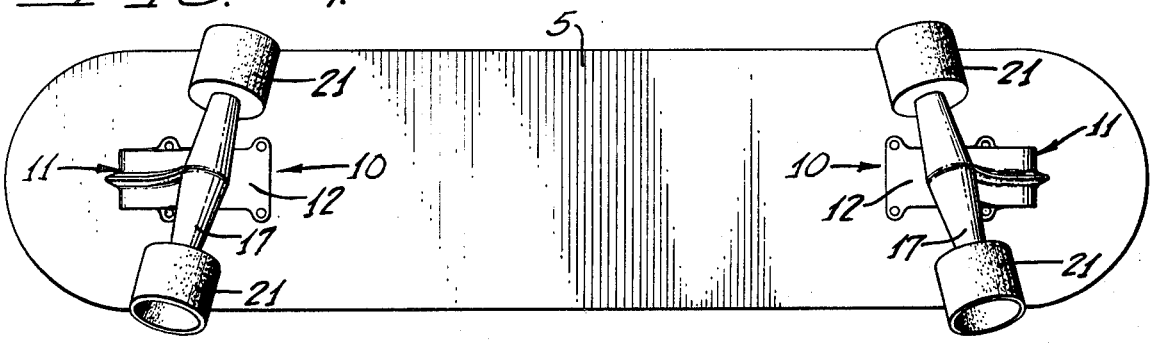
FIG. 7 is a bottom plan view of the skateboard of FIG. 1 showing the opposite turning action of the two trucks.

Section 16 is aligned generally vertically when connected to skateboard 5, perpendicular to baseplate 12, and functions to resist vertical deflection of beam 11 relative to baseplate 12. That is, beam 11 flexes about its one end in response to loads placed thereon from board 5 and these forces are resisted by beam section 16. Beam section 16 also provides a plane for pivoting of truck 10, such as shown in FIG. 6, to permit steering of skateboard 5. When turning skateboard 5, in a conventional manner, trucks 10 pivot around vertical beam sections 16 in opposite directions, as shown in FIG. 7, to permit maneuvering of skateboard 5.

Truck 10 also includes an elongate, generally cylindrical axle hub 17 connected to the other end of beam 11 and extending perpendicular thereto. As seen in FIG. 1, beam section 15 pushes axle hub 17 in front of the rear truck 10 and pulls axle hub 17 in back of the front truck 10. Because of the width of beam section 15, there is too much material either pushing axle hub 17 or pulling axle hub 17 to allow the forces applied thereto to cause it to wobble in the horizontal plane.

In other words, beam 11 is basically a composite beam, each of whose sections 15 and 16 perform a separate function. Vertical section 16 provides the strength to beam 11 to support it in the presence of forces and also provides a plane for the twisting action of beam 11 to permit steering. Horizontal section 15 provides stability between baseplate 12 and axle hub 17 to prevent wobble.

According to the present invention, baseplate 12, beam 11 and axle hub 17 are injection molded as a one-piece unit from Dupont Zytel. In order to complete a wheel assembly, it is only necessary to fit each truck 10 with a length of axle tubing and an axle. Specifically, axle hub 17 has a cylindrical bore extending therethrough which is fitted with a length of tubing 18 which may be molded therein during the molding operation. Tubing 18 serves to permit the ready insertion of axle means 19 which is preferably a single axle which extends entirely through axle hub 17. As is conventional in trucks, the opposite ends of axle 19 are threaded, as shown at 20, for receipt of conventional wheels 21.

The inherent strength of Dupont Zytel is such that truck 10 will withstand the normal and usual forces that a truck is subjected to. However, it is common for skates to be used in a manner that the trucks are subjected to dynamic loading forces of 2 g's and more. In such cases, beam 11 might deflect by an amount sufficient to prevent accurate maneuvering thereof. Therefore, according to the preferred embodiment of the invention, truck 10 further includes an impact peg or post 25 which, in one embodiment, is a generally elongate, cylindrical member. One end of peg 25 is rigidly connected to baseplate 12 such as by a screw 26 extending through a central hole in baseplate 12 and engaging an internally threaded bore in one end of peg 25. The other end of peg 25 either contacts or is positioned adjacent to a central point along the length of axle hub 17.

Peg 25 performs a number of functions. Initially, it prevents beam 11 from deflecting by an amount which would cause it to lose its structural integrity. The end of peg 25 adjacent to axle hub 17 also provides a pivot point for rotation of axle hub 17, as should be apparent from an inspection of FIG. 6. Furthermore, the configuration of peg 25 allows one to tailor to individual riders the characteristics of truck 10.

More specifically, the configuration of peg 25 shown in the drawings presents almost no resistance to rotation of axle hub 17, it merely provides a point around which hub 17 rotates and resists vertical deflection of beam 11. On the other hand, if the radius at the tip of peg 25 were changed and the peg widened in such a way that there is a resistance to turning caused by the configuration of peg 25, this would effect the ability of hub 17 to rotate. At one extreme, the end of peg 25 could be flat and offer a significant resistance to turning. In an intermediate configuration, with the tip of peg 25 elongated laterally and slightly rounded, there would still be turning about a certain point, but it would be resisted relative to the radius on the tip of peg 25 and the width of the radius relative to the turning. In this manner, one could create a resistance to turning which increases stability or at least the feeling of stability because of an increased force necessary to turn truck 10. This permits one to tailor the turning characteristics of truck 10 to different individuals merely by changing peg 25. Thus, a light person who enjoys a particularly light tension would use the peg 25 shown in the drawings. A heavier person wanting a greater feeling of stability and requiring an increased force for turning, would use a widened peg having a larger radius. To convert a truck 10 for use by one person to another, it would be necessary to change the peg 25. This would be a permanent change and no further adjustments would be required.

Thickening the cross-section of horizontal beam section 15 would also cause more resistance to turning, as would thickening and heightening vertical beam section 16. This is another example of the flexibility offered by a truck constructed in accordance with the teachings of the present invention.

While a beam having the configuration shown in FIG. 3 is the preferred shape of a beam for a skate configuration, it should be apparent to those skilled in the art that other types of beam cross-sections could be used. There are many different configurations of deflecting beams which might work almost as well and, perhaps, as well, if not better than the configuration shown. The significant feature of truck 10 is its inclusion of beam 11, not the specific configuration shown.

It can therefore be seen that according to the present invention, there is disclosed a totally new concept in trucks which solves all of the problems discussed thereinbefore. Truck 10 is virtually a one-piece member and has no parts whatsoever which require adjustment or readjustment. Truck 10 is extremely maneuverable and is highly insensitive to high speed wobble. Because of the minimum number of parts, truck 10 requires a minimum of time and labor to assembly. Furthermore, because of the absence of adjustments, a skate incorporating truck 10 rides in a totally pedictable way.

Truck 10 is highly insensitive to vibrations from road and surface irregularities. This is because the vibrations are conducted through the entire length of beam 11 where they may be absorbed. Truck 10 is made entirely from plastic so that there is no necessity to add separate parts to permit truck 10 to slide smoothly over surfaces. This is because the plastic material has a low coefficient of friction.

Truck 10 cannot corrode, weighs significantly less than conventional trucks, has an extremely high direct impact resistance, and typically will not break without warning.

Due to the solid construction of truck 10, it is predictable and reacts exactly the same when forces are put upon it. No adjustments are required. Beam 11 of truck 10 includes a vertical section 16 which provides resistance to vertical deflection relative to forces which give a shock action and creates a neutral or central point of turning. Beam 11 also includes a horizontal section 15 which causes a slight resistance to turning but, more importantly, holds axle hub 17 in such a way as to prevent wobbling.

Truck 10 is almost entirely injection molded. All that is required for assembly is the addition of axle 19 and impact peg 25. Both axle 19 and impact peg 25 can be molded in one-piece with the remainder of truck 10 if desired. Because baseplate 12, beam 11 and axle hub 17 are made in one-piece, as long as the molecules do not fatigue, the entire unit is viable. While truck 10 is not indestructible, when it is worn out it is cheap enough to throw away and replace.

While the invention has been described with respect to the preferred physical embodiment constructed in accordance therewith, it will be apparent to those skilled in the art that various modifications and improvements may be made without departing from the scope and spirit of the invention. Some of the possible modifications and improvements have already been discussed herein. Accordingly, it is to be understood that the invention is not to be limited by the specific illustrative embodiment, but only by the scope of the appended claims.

I claim:

1. A skate truck comprising: an elongated beam of flexible material having a width substantially greater than the thickness thereof, said beam including:

(a) a first unitary member extending in a plane generally parallel to the bottom of a skate to which it is adapted to be attached;

(b) a second unitary member formed with one end integral with the first member and the plane of the second member extending at an acute angle to the plane of the first member, the second member having at its other end an axle or axle hub connected thereto; and (c) the second member including an elongated section extending along the longitudinal axis of the second member, centrally thereof, and normal to the axis of the axle or axle hub, the elongated section lying in a plane at right angles to the plane of the second member thereby providing resistance to vertical deflection and a twisting axis to the second member.

2. A skate truck comprising: an elongated beam made entirely from a flexible material, one end of said beam being adapted to be rigidly anchored to a skate and said beam having a portion extending at an acute angle relative the skate, the cross-section of said beam including:

(a) a first section, the width of which being significantly greater than the thickness thereof, said first section being positioned generally transverse to the longitudinal axis of the skate when said beam is connected thereto; and (b) a second section extending longitudinally of said beam, perpendicular to said first section, from one side thereof, and generally midway between the opposite side edges thereof, for resisting vertical deflection of said beam; and (c) an elongated axle or axle hub rigidly connected to the other end of said beam and extending perpendicular to said first and second sections thereof, said first section of said beam supporting said axle or axle hub so as to minimize wobble thereof.

3. A skate truck according to claim 1 or 2, wherein said beam is molded in one piece from a plastic material.

4. A skate truck according to claim 1 or 2, wherein said beam and said axle or axle hub are molded in one piece from a plastic material.

5. A skate truck according to claim 2, further comprising: an elongated, planar baseplate on said beam and being molded in one piece with said beam.

6. A skate truck according to claim 5, further comprising: an impact post, one end of said post being rigidly connectable to said baseplate, the body of said post extending perpendicular to said baseplate, the other end of said post terminating in a position adjacent to said axle or axle hub for providing a pivot point for rotation of said axle or axle hub, said axle or axle hub being adapted to rest on said other end of said post.

7. A skate truck according to claim 6, wherein the shape of said other end of said impact post is selected to control the ease of rotation of said axle or axle hub whereby the shape of said other end of said impact post may be selected to tailor to an individual rider the turning characteristics of said truck.

8. A skate truck comprising: an elongated beam made from a flexible plastic material, one end of said beam being adapted to be rigidly anchored to a skate with a portion of said beam extending at an acute angle relative to the skate, the cross-section of said beam including:

(a) a first section, the width of which is significantly greater than the thickness thereof, said first section being positioned generally transverse to the longitudinal axis of the skate when said beam is connected thereto; and (b) a second section extending longitudinally of said beam, perpendicular to said first section, from one side thereof, approximately midway between the opposite sides thereof, for resisting vertical deflection of said beam;

(c) said beam being an entirely one piece, solid member; and (d) an elongated axle or axle hub rigidly connected to the other end of said beam and extending perpendicular to said second section thereof, said first section of said beam minimizing wobble of said axle or axle hub.

9. A skate truck according to claim 8, wherein said beam and said axle or axle hub are molded in one piece from a plastic material.

10. A skate truck according to claim 8 or 9 further comprising: an elongated, planar baseplate at said one end of said beam and being molded in one piece with said beam.

11. A skate truck according to claim 10 further comprising: an impact post, one end of said post being rigidly connectable to said baseplate, the body of said post extending perpendicular to said baseplate, the other end of said post terminating in a position adjacent to said axle or axle hub for providing a pivot point for rotation of said axle or axle hub, said axle or axle hub being adapted to rest on said other end of said post.

12. A skate truck according to claim 11, wherein the shape of said other end of said impact post is selected to control the ease of rotation of said axle hub whereby the shape of said other end of said impact post may be selected to tailor to an individual rider the turning characteristics of said truck.

* * * * *